United States Patent [19]

Ringdahl et al.

[11] Patent Number: 4,516,007

[45] Date of Patent: May 7, 1985

[54] INTERLOCK SWITCH MODULE FOR A MICROWAVE OVEN

[75] Inventors: Mark G. Ringdahl, Chanhassen; Lambert L. Raymond, Robbinsdale; Richard J. Scherer, Woodbury, all of Minn.

[73] Assignee: Litton Systems, Inc., Beverly Hills, Calif.

[21] Appl. No.: 409,685

[22] Filed: Aug. 19, 1982

[51] Int. Cl.[3] ..... H05B 6/68

[52] U.S. Cl. ..... 219/10.55 D; 219/10.55 D; 200/50 A; 200/50 C; 200/61.62; 200/293; 126/197

[58] Field of Search ..... 219/10.55 C, 10.55 D, 219/10.55 B, 10.55 R; 200/50 A, 50 C, 50 R, 61.62, 61.64–61.68, 61.76–61.82, 61.7, 61.71, 293–295; 126/197, 194

[56] References Cited

U.S. PATENT DOCUMENTS

| | | | |
|---|---|---|---|
| 1,915,239 | 6/1933 | Potter et al. | 200/61.79 |
| 2,681,966 | 6/1954 | Christensen | 200/293 |
| 3,309,471 | 3/1967 | Korrell | 200/293 X |
| 3,691,329 | 9/1972 | Ball | 219/10.55 C |
| 3,777,098 | 9/1972 | Tapper | 219/10.55 C |
| 3,865,097 | 2/1975 | Robinson | 126/197 |
| 4,096,370 | 6/1978 | Duncan | 219/10.55 C |
| 4,101,750 | 7/1978 | Doner | 219/10.55 C |
| 4,201,901 | 5/1980 | Schuchert | 219/10.55 C |
| 4,321,445 | 3/1982 | Kristof et al. | 219/10.55 C |
| 4,323,747 | 4/1982 | Takase et al. | 219/10.55 C |
| 4,453,065 | 6/1984 | Taylor, Jr. et al. | 219/10.55 D |

FOREIGN PATENT DOCUMENTS 2010954 7/1979 United Kingdom .

*Primary Examiner*—Philip H. Leung
*Attorney, Agent, or Firm*—John M. Haurykiewicz; Walter R. Thiel

[57] ABSTRACT

An interlock switch module for a microwave oven provides a unitary housing containing primary and secondary interlock switches, interlock and logic monitor switches, and a cavity lamp switch. Apertures are provided in the housing to receive actuators external of the switch module. One actuator is contained within the module and is adapted to be actuated by a portion which protrudes from the module. Sequencing and timing of the switches are provided for.

19 Claims, 6 Drawing Figures

INTERLOCK SWITCH MODULE FOR A MICROWAVE OVEN

BACKGROUND OF THE INVENTION

This invention relates to electrical apparatus and more particularly to an interlock switch module for microwave ovens.

The design and construction of microwave ovens is governed by Federal Regulations promulgated by the Bureau of Radiological Health (BRH) to insure safe operation of such ovens.

BRH regulations require that an access door on a microwave oven be latched and interlocked to prevent opening the door while microwave radiation is present within the oven. At least two interlock switches are required to open up the electrical supply circuit to the oven's magnetron or other source of microwave radiation.

It has been common practice to meet BRH requirements with a plurality of independent switches, each separately mounted. Independent installation, wiring and adjustment of each switch is required to be made at the time the oven was assembled, resulting in a time consuming and hence costly step in the manufacture of microwave ovens. Furthermore, because such switches were typically independently mounted, attention was generally not given to the sequencing or relative timing of such switches, and even if properly sequenced and timed, such switches were subject to moving out of proper adjustment because of the many parts subject to loosening through vibration and wear.

SUMMARY OF THE INVENTION

This invention overcomes the shortcomings of prior interlock switch arrangements, by providing an interlock switch module wherein all of the switches are arranged in fixed relationship to each other, obviating the need for relative adjustment among switches. The interlock switch module of this invention provides for the proper timing and sequencing of interlock switches, making the interlock switch module less expensive, more reliable and also more compatible with electronic controllers.

DETAILED DESCRIPTION

Figure 1:
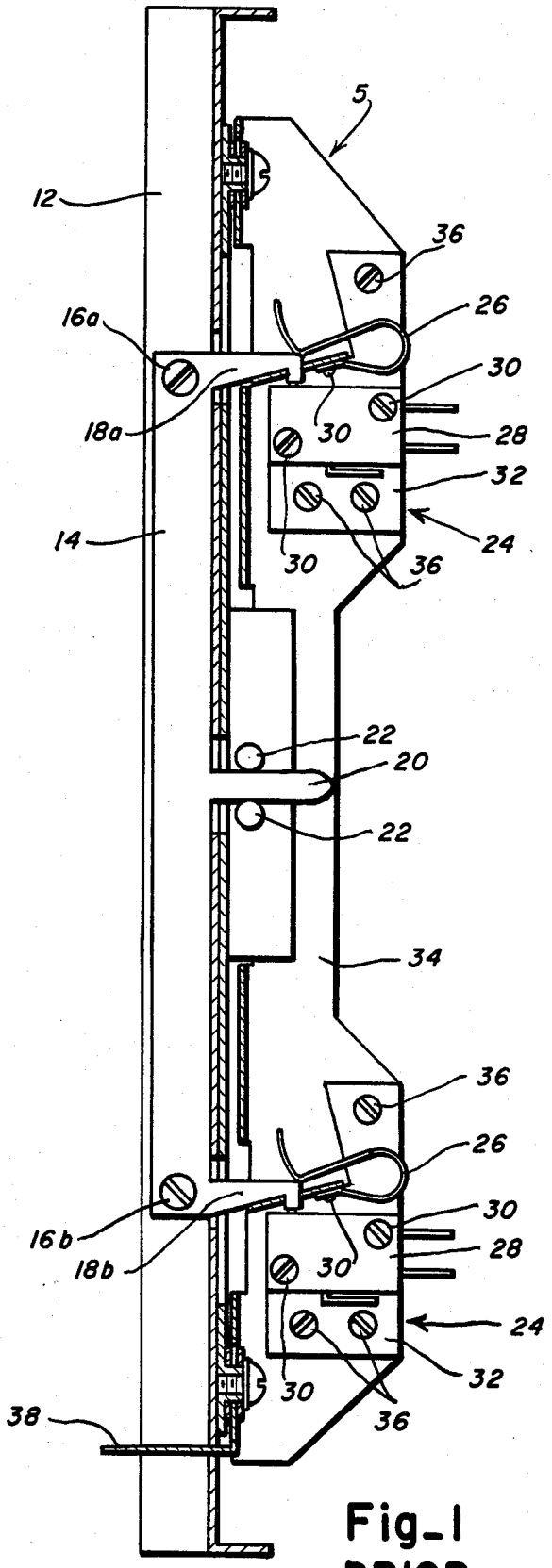
Fig 1 PRIOR ART
FIG. 1 is a side view of a prior art interlock switch mechanical assembly.

FIG. 1 shows a prior art interlock switch assembly 5. An oven door 12 has an actuator plate 14 secured to it by means of screws 16*a* and *b*. Actuator plate has latch hooks 18*a* and *b* and a projection 20. Projection 20 is received within rollers 22 when the door is closed, and each of latch hooks 18*a* and *b* is received in a switch spring assembly 24. Switch-spring 24 includes a leaf spring 26 urging the latch hook 18*a* or *b* into engagement with a switch 28 when the door is closed. Spring 26 and switch 28 are mounted by means of screws 30 to a mounting plate 32 which itself is secured to a door release plate 34 by means of additional screws 36. To release the door a projection 38 on plate 34 is depressed causing plate 34 to move the switch-spring assemblies 24 out of engagement with latch hooks 18*a* and *b*. At that point, leaf springs 26 urge door 12 open.

As may be seen from FIG. 1, each switch 28 and its respective assembly 24 must be individually attached and adjusted in order for the entire assembly 5 to be satisfactorily operable. For instance, if one or both assemblies 24 is not properly located, door 12 may not close, or alternatively may not open upon actuation of projection 38. Additionally, should a switch 28 be misaligned within its assembly 24, the switch may not be actuated by latch hook 18*a* or *b*, and hence will prevent the oven from operating even though the door is closed and latched.

Figure 2:
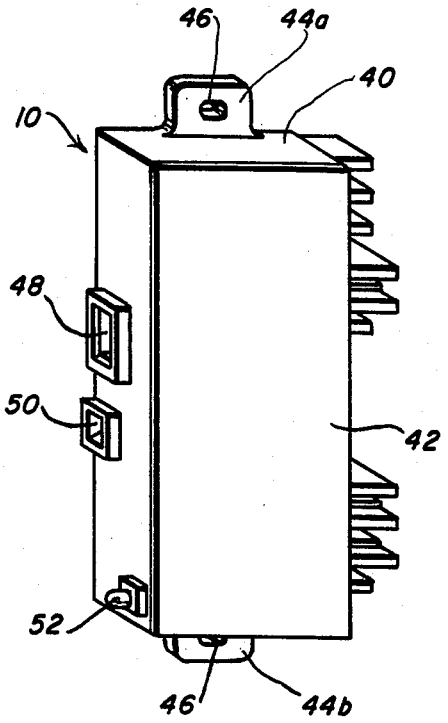
FIG. 2 is a perspective view of the interlock switch module.

To overcome the disadvantages of such prior art interlock switch assemblies, an interlock switch module 10 has been invented and is shown in FIG. 2. Preferably module 10 is a unitary molded or formed housing 40 which may have a cover 42 to permit initial assembly of the components within the housing. Cover 42 is then secured to housing 40 by any conventional means. Housing 40 includes ears 44*a* and *b* suitable for mounting housing 40. Ears or mounting means 44*a* and *b* each have an extended aperture or slot 46 contained therein. Housing 40 further includes apertures 48 and 50 which are intended to receive door mounted projections similar to 18*a* and 20 respectively. The interlock switch module 10 also includes a switch mounted actuator which has a projection 52 extending through housing 40.

Figure 5:
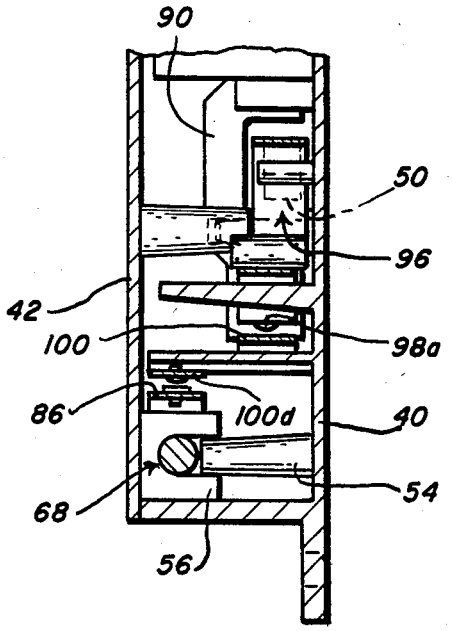
FIG. 5 is a rear partial section view of the interlock switch module.
Figure 3:
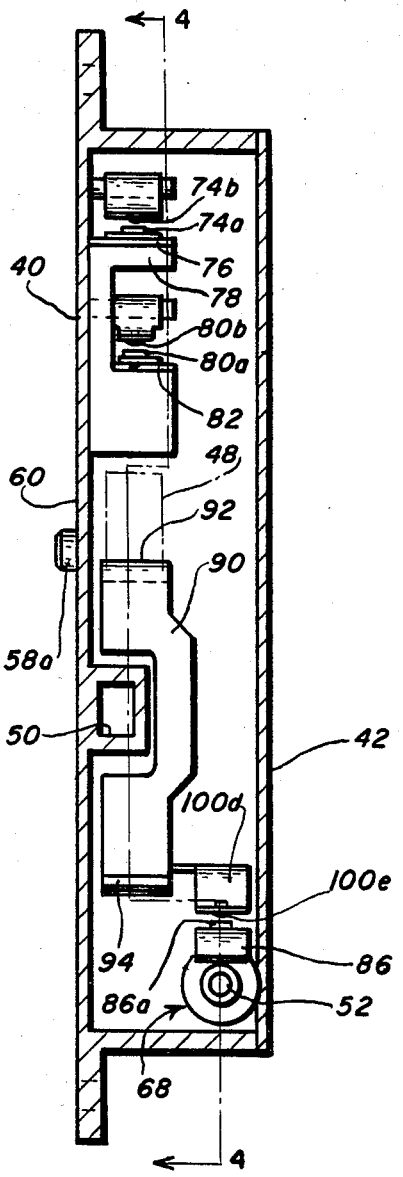
FIG. 3 is a front section view of internal details of the interlock switch module.
Figure 4:
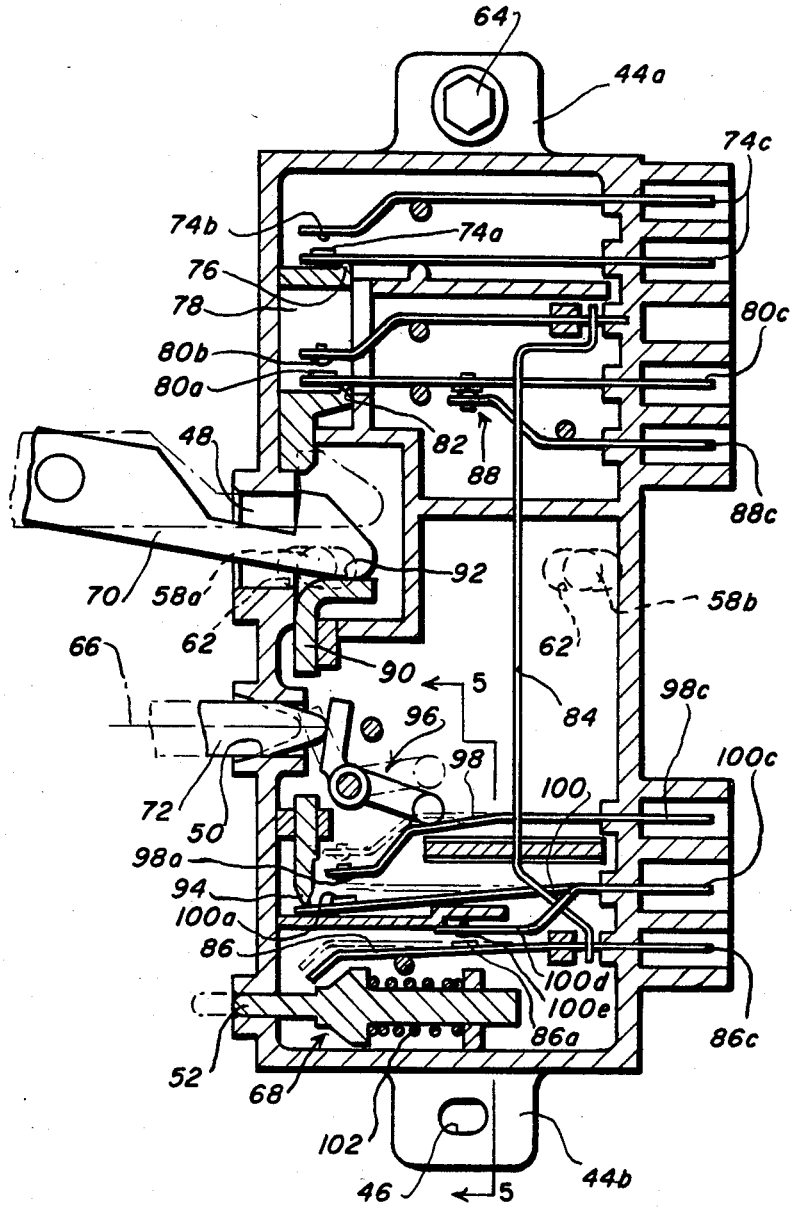
FIG. 4 is a side section view of the interlock switch module.

The internal details of the interlock switch module 10 are shown in FIGS. 3, 4 and 5. In addition to a switch mounted actuator 68, FIG. 4 shows a pair of door mounted actuators 70 and 72. Actuator 70 is a latching type actuator, while actuator 72 is a bayonet type actuator. In addition, FIGS. 3 and 4 show studs 58*a* and 58*b* which preferably protrude from a base portion 60 of the housing 40. Each of the studs 58*a* and *b* is intended to be received in an elongated hole or slot 62 in the portion of the mounting surface of the oven (not shown) to which the module 10 is attached.

Referring now more particularly to FIGS. 3 and 4, the preferred embodiment includes a pair of logic monitor switch contacts 74*a* and 74*b*, brought out to a pair of terminals 74*c*. Contact 74*a* is driven by a first projecting surface 76 of sliding member 78. Contacts 80*a* and 80*b* are the primary interlock switch contacts, with contact 80*a* driven by a second projecting surface 82 of sliding member 78. Contact 80*a* is brought out to terminal 80*c*. Contact 80*b* is connected by jumper 84 to terminal 86*c*. An additional pair of contacts 88 are shown in this embodiment. Connection is made to contacts 88 at terminals 80*c* and 88*c*. Contacts 88 are used to operate the light for the interior of the microwave oven cavity in a conventional manner. Sliding member 78 is shown in its rest position, corresponding to the position of actuator 70 shown by solid lines. As will be described in more detail later, sliding member 78 is driven by actuator 70 and will open and close contacts 74*a* and *b* and 80*a* and *b* in a specific sequence as actuator 70 moves between the positions shown in solid and phantom lines. The phantom line position of actuator 70 corresponds to a closed and latched position of a corresponding microwave oven door. The solid line position of actuator 70 corresponds to an unlatched but closed position of the microwave oven access door. As actuator 70 moves between its latched and unlatched positions with the door remaining closed, it operates sliding member 90. Sliding member 90 has an upper cam surface 92 and a lower projecting surface 94. When the microwave oven access door is closed, actuator 72 drives pivoting member 96 to the position shown in solid lines, deflecting leaf spring 98 which carries contact 98*a* and is connected electrically to terminal 98*c*. With actuator 70 in the unlatched position shown by the solid lines, sliding member 90 is driven through upper cam surface 92 causing lower projecting surface 94 to deflect leaf spring 100, carrying contact 100*a* and connected electrically to terminal 100*c*. Terminals 98*a* and 100*a* comprise the secondary interlock switch contact pair in the embodiment of FIG. 4. When latching actuator 70 is in the latched position shown by the dotted lines, sliding member 90 allows leaf spring 100 to relax, permitting contacts 100*a* and 98*a* to make electrical connection.

Switch mounted actuator 68 is shown in its depressed position corresponding to a closed microwave oven access door. As the oven door is allowed to open, actuator 68 is driven by spring 102 and engages leaf spring 86 which carries contact 86*a*. Contacts 86*a* and 100*e* are the interlock monitor switch contacts. With the microwave oven door open, actuator 68 causes engagement of contact 86*a* with contact 100*e* carried on a bifurcated arm 100*d* of leg spring 100. With the microwave oven access door open, both actuators 70 and 72 are withdrawn from the interlock switch module, allowing sliding members 90 and 96 to move from the positions shown in solid lines, permitting leaf springs 98 and 100 to relax to the positions shown in dotted lines, at which time contacts 98*a* and 100*a* are in an open circuit position.

Referring now more particularly to FIG. 5 a partial section view of the embodiment of FIG. 4 is shown. In this view aperture 50 is shown in phantom and additional details of pivoting member 96 may be seen. Switch mounted actuator 68 is seen to be slideably retained between post 54 which is formed integrally with housing 40 and channel 56 which is preferably formed as a part of cover 42.

Referring now more particularly to FIG. 4, switch module 10 is preferably mounted by loose attachment with a pair of conventional threaded fasteners or bolts 64 (shown only in upper ear 44*a*). The oven door is then closed and the module 10 is positioned as far from the door as possible with actuator 70 in the latched (phantom) position. Bolts 64 are then securely tightened, anchoring module 10 in its proper location with respect to the actuators 70 and 72 and securing it against further movement. By positioning module 10 as described, the oven door is held fully closed when actuator 70 is latched; the door will not begin to open until after actuator 70 is unlatched and the primary interlock switch has opened, thus ensuring that power to the magnetron is interrupted. Since studs 58*a* and *b* are received in slots 62, only adjustment in line with the principal axis 66 of actuator 72 is possible, thus maintaining accurate registration between apertures 48, 50 and actuators 70, 72.

Figure 6:
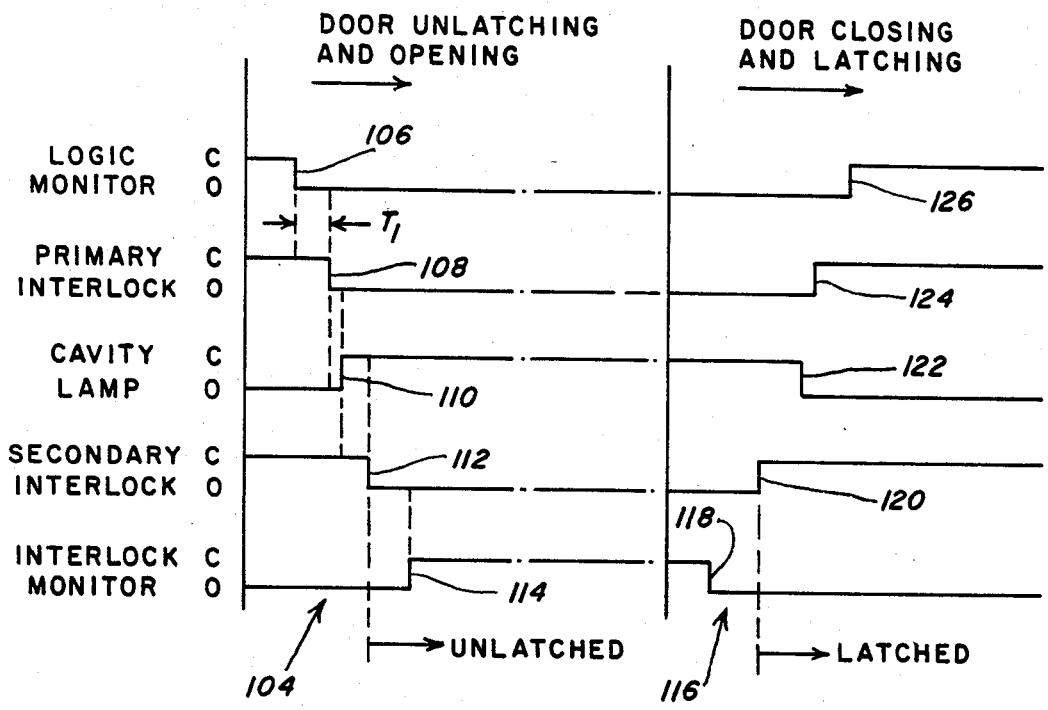
FIG. 6 is a timing diagram of the operation of the interlock switch module.

Referring now to FIG. 6, the operation of the interlock switch module will be described. Sequence 104 illustrates switch events upon the operation of access door unlatching and opening. In those ovens with electronic controllers which have solid state control of the current through contacts 80*a* and *b* as for example by means of a triac or SCR, the first switch event to occur upon a user initiated command to unlatch and open the door is the opening of the logic monitor switch contacts 74*a* and 74*b* shown in the timing diagram as transition 106. The elements of the interlock switch module are preferably designed to delay the next switching event, transition 108, (which is opening of the primary interlock switch contacts 80*a* and 80*b*) for a predetermined time $T_1$ equal to or greater than one half cycle of the electrical power supply frequency to the microwave oven. For a 60 Hz supply frequency, $T_1$ is greater than or equal to 8.33 msec. With such a delay, the primary interlock switch can open under "dry circuit" or zero current conditions, thus prolonging contact life. It is to be understood that the logic monitor switch function is inapplicable in ovens controlled by mechanical timers or the like. In those ovens, the first effective switch event upon door unlatching and opening is transition 108. The next event to occur is the open to closed transition of the cavity lamp contacts 88 shown as transition 110. The next switch event to occur upon door unlatching is the closed to open transition 112 of the secondary interlock contacts 98*a* and 100*a*. Finally transition 114 from an open to a closed condition occurs at the interlock monitor switch contacts 86*a* and 100*e*. It is to be noted that the microwave oven access door is unlatched at transition 112 and door opening begins at that point and it is the door opening motion that results in interlock monitor transition 114. In summary, the salient parts of sequence 104 are the sequence of transitions 106, 108, 112 and 114 and the delay time of $T_1$ between transitions 106 and 108.

Sequence 116 shows the preferred order of switch closures upon door closing and latching. The first event to occur is transition 118 from a closed to an open condition of the interlock monitor. The second event to occur is transition 120 of the secondary interlock contacts from an open to a closed condition. Next the cavity lamp contacts 88 are opened at transition 122, the primary interlock is closed at transition 124, and finally the logic monitor contacts are closed at transition 126. It may be noted that the microwave oven access door is fully closed and latched at transition 120 during sequence 116.

Referring now again more particularly to FIG. 4, when latching actuator 70 moves from the latched or phantom position towards its solid line position, sliding member 78 is permitted to move in a direction to allow contacts 74*a* and *b* to open. As member 78 continues its motion, contacts 80*a* and *b* subsequently open and contacts 88 close. As actuator 70 continues in an unlatching direction, it contacts upper cam surface 92 of sliding member 90 and thereafter causes a downward motion of member 90 subsequently causing deflection of leaf spring 100 and initiating opening of secondary interlock contact 100*a*. Once actuator 70 is in the fully unlatched position, the microwave oven door may be opened, withdrawing actuators 70 and 72 from the interlock switch module. As the access doors open, pivoting member 96 rotates as it follows the withdrawal of actuator 72, causing relaxation of leaf spring 98 and upward motion of interlock switch contact 98*a* thus maintaining the open condition of contacts 98*a* and 100*a* while the oven door opens. It should be understood that even though leaf spring 100 will return to its relaxed state following the withdrawal of actuator 70, the relaxation of leaf spring 98 will maintain an open circuit between terminals 98*c* and 100*c*.

The invention is not to be taken as limited to all of the details thereof as modifications and variations thereof may be made without departing from the spirit or scope of the invention, as for example it is to be understood to be within the scope of the invention to substitute sliding for rotating parts or vice versa and also by way of example it is to be understood further to be within the scope of the invention that actuators may be interchanged, as for example actuators 68 and 72 may be exchanged and still provide the desired functions in the interlock switch module.

Accordingly what is claimed is:

1. An interlock switch module for use in a microwave oven comprising:

(a) a unitary housing having a generally flat surface containing actuator apertures therein and having mounting means formed as a part thereof; and (b) a plurality of interlock switches positively located in said housing such that such switches are fixed relative to said apertures and further that said switches are positionable only along an axis substantially perpendicular to said flat surface and only as a group with respect to actuators when said actuators are received in said apertures by positioning and securing said mounting means on an adjacent mounting surface.

2. An interlock switch module for use in a microwave oven comprising:

(a) a molded housing having:

(i) a base with integral mounting means and a substantially planar wall having a plurality of actuator apertures fixed therein, (ii) a cover, and (iii) means to make a plurality of electrical connections to the switch module;

(b) a plurality of interlock switches secured within said housing and operable by a plurality of actuators acting through said apertures to provide a repeatable sequence of interlock switch transitions upon oven door operations such that positioning of said switches with respect to said actuators is accomplished solely by adjusting and securing said housing in the oven by its integral mounting means along an axis substantially perpendicular to said planar wall.

3. An improved interlock switch assembly for interlocking an access door of a microwave oven having an electrical supply circuit, the improved assembly comprising:

(a) a unitary housing having mounting means for mounting said housing to a microwave oven;

(b) first and second interlock switches fixedly mounted in said housing and adapted to break the electrical supply circuit to a microwave radiation source when said access door is released and opened;

(c) initiation means to open said first and second interlock switches in response to the release of said access door preparatory to opening, and (d) maintaining means to maintain said second interlock switch open in response to opening movement of said access door.

4. An interlock switch module for use in a microwave oven comprising:

(a) a rigid enclosure for a plurality of interlock switches having:

(i) a base formed to receive individual switch elements, (ii) a first wall secured to said base and having an actuator aperture therein to receive an actuator along a principal axis as the access door of the microwave oven is closed, and (iii) mounting means secured to said base and adapted to permit adjustment of the location of said enclosure only along said principal axis;

(b) a plurality of interlock switches positively located with respect to said base;

(c) first means within said enclosure to cause a first actuation from among said interlock switches upon receiving motion of said actuator corresponding to unlatching of said access door; and (d) second means within said enclosure to cause a second actuation from among said interlock switches upon receiving motion of said actuator corresponding to opening of said access door.

5. The interlock switch module of claim 4 further comprising means permitting adjustment of the position of said enclosure only substantially perpendicularly to said first wall.

6. An interlock switch module for use in a microwave oven comprising:

(a) a primary interlock switch;

(b) a secondary interlock switch;

(c) an interlock monitor switch; and (d) a unitary housing containing:

(i) said primary and secondary interlock switches and said interlock monitor switch, (ii) an aperture adapted to receive a latching actuator, (iii) first means adapted to sense unlatching of said actuator and operative to open said primary interlock switch, (iv) second means adapted to sense unlatching and withdrawal of said actuator from said aperture and operative to open said secondary interlock switch, (v) means adapted to sense further withdrawal of said actuator and operative to close said interlock monitor switch, and where said housing is further comprised of mounting means adapted to allow adjustment of said housing with respect to said actuator upon initial installation of said housing in said oven and thereafter secures said housing to said oven.

7. The interlock switch module of claim 6 further comprising a logic monitor switch and wherein said first means adapted to sense unlatching of said actuator is operative to open said logic monitor switch before opening said primary interlock switch.

8. The interlock switch module of claim 6 wherein said switches comprise contacts carried on leaf springs.

9. The interlock switch module of claim 6 wherein said first means comprises a first sliding member which follows the unlatching motion of said actuator.

10. The interlock switch module of claim 9 wherein said second means comprises a second sliding member which follows both unlatching and withdrawal of said actuator.

11. The interlock switch module of claim 10 wherein said unitary housing further contains a second aperture adapted to receive a sliding actuator and said second means further comprises a pivoting member which pivots in response to withdrawal of said sliding actuator.

12. An interlock switch assembly for use in interlocking an access door of a microwave oven, the assembly comprising:

(a) a housing having an external surface with at least two apertures therein each adapted to receive an actuator;

(b) an interlock switch located in a fixed position in said housing;

(c) initiation means adapted to be driven by a first actuator to initially actuate said interlock switch in response to a first movement of said first actuator corresponding to a user initiated door opening command; and (d) maintaining means adapted to be operated by a second actuator to maintain actuation of said interlock switch upon release of said initiation means by said first actuator.

13. An improved interlock switch assembly for use in microwave ovens which have an access door and electrical supply circuit, the assembly comprising:

(a) a plurality of interlock switches;

(b) a housing having first and second apertures to permit entry of first and second actuators into said housing upon closing of the oven access door where said housing is adapted to enclose, secure and positively locate each of said switches with respect to each other and with respect to said apertures;

(c) initiation means driven by the transmitted motion of said first actuator to begin actuation of one of said interlock switches; and (d) maintaining means driven by the transmitted motion of said second actuator to continue actuation of said one interlock switch upon loss of transmitted motion of said first actuator.

14. In a microwave oven of the type having a latching access door, an electronic controller, and a microwave radiation source operating from an alternating current electrical supply, an improved interlock switch assembly in combination therewith comprising:

(a) a logic monitor switch to signal said electronic controller upon detection of the initiation of release of said access door prior to opening;

(b) a primary interlock switch to open an electrical circuit between said alternating current electrical supply and said microwave radiation source upon further release of said access door prior to opening; and (c) delay means to delay said primary interlock switch opening until a time equivalent to at least one half cycle of said alternating current electrical supply has elapsed since said logic monitor switch signal to said electronic controller.

15. The apparatus of claim 14 further comprising:

a secondary interlock switch operative to open the electrical circuit between said alternating current electrical supply and said microwave radiation source where said secondary interlock switch is opened by initiation means responsive to unlatching of said access door from said oven prior to opening of said access door.

16. The apparatus of claim 15 further comprising:

maintaining means responsive to opening movement of said access door and operative to maintain said secondary interlock switch open while said access door is open.

17. An improved microwave oven and interlock switch assembly combination comprising:

(a) a microwave oven;

(b) an access door pivotably secured to said oven and carrying a latching actuator;

(c) a housing secured to said oven, said housing containing an interlock switch and including:

(i) a first aperture for receiving said latching actuator and operative to latch said access door to said oven upon receiving said actuator, (ii) initiation means responsive to unlatching of said actuator and operative to open said interlock switch, and (iii) maintaining means responsive to opening of said access door and operative to hold open said interlock switch while said access door is open.

18. The assembly of claim 17 wherein said latching actuator is pivotally mounted on said door.

19. The assembly of claim 18 wherein said initiation means is responsive to a pivoting movement of said actuator.

* * * * *